US010767344B2

(12) United States Patent
Haberman et al.

(10) Patent No.: US 10,767,344 B2
(45) Date of Patent: Sep. 8, 2020

(54) HYDRAULIC DRIVE CONTROL

(71) Applicant: Clark Equipment Company, West Fargo, ND (US)

(72) Inventors: William E. Haberman, West Fargo, ND (US); Christopher L. Young, Fargo, ND (US); Timothy J. Alger, Sheldon, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 0 days.

(21) Appl. No.: 16/410,576

(22) Filed: May 13, 2019

(65) Prior Publication Data

US 2019/0345691 A1 Nov. 14, 2019

Related U.S. Application Data

(60) Provisional application No. 62/670,360, filed on May 11, 2018.

(51) Int. Cl.

| | |
|---|---|
| ***F15B 21/04*** | (2019.01) |
| ***E02F 9/22*** | (2006.01) |
| ***F15B 11/02*** | (2006.01) |

(52) U.S. Cl.

CPC ..... *E02F 9/22* (2013.01); *F15B 11/02* (2013.01); *F15B 21/04* (2013.01); *F15B 2211/205* (2013.01); *F15B 2211/275* (2013.01)

(58) Field of Classification Search

CPC .... F15B 21/04; F15B 21/042; F15B 21/0423; F15B 21/0427; F15B 11/02; F15B 2211/205; F15B 2211/275; E02F 9/22; E02F 9/2296; E02F 9/2235

See application file for complete search history.

(56) References Cited

U.S. PATENT DOCUMENTS

| | | | |
|---|---|---|---|
| 5,410,878 | A | 5/1995 | Lee et al. |
| 5,468,126 | A | 11/1995 | Lukich |
| 5,941,689 | A | 8/1999 | Skirde |

(Continued)

FOREIGN PATENT DOCUMENTS

EP 3015609 A1 5/2016

OTHER PUBLICATIONS

International Search Report and Written Opinion dated Jun. 29, 2019 for International Application No. PCT/2019/032007 filed May 13, 2019, 12 pages.

*Primary Examiner* — Thomas E Lazo

(74) *Attorney, Agent, or Firm* — Westman, Champlin & Koehler, P.A.

(57) ABSTRACT

Power machines having hydraulic systems and controllers configured to prohibit, limit, or allow full operation of the hydraulic systems based upon measured temperature of the hydraulic oil in the system are provided. Also included are methods of controlling the hydraulic systems. In the methods implemented by the controllers, determinations are made as to whether the temperature of the hydraulic oil is below a first (and lowest) set point temperature, above a second (and higher) set point temperature, or between the first and second set point temperatures. The controllers then either prohibit hydraulic system operation, allow limited hydraulic system operation, or allow full hydraulic system operation, based upon the measured temperature in comparison to the two or more set point temperatures.

19 Claims, 6 Drawing Sheets

(56) References Cited

U.S. PATENT DOCUMENTS

| | | | | |
|---|---|---|---|---|
| 6,305,419 | B1 | 10/2001 | Krieger et al. | |
| 6,966,180 | B2 | 11/2005 | Deneir et al. | |
| 7,469,534 | B2 | 12/2008 | Nishi et al. | |
| 7,613,560 | B2 | 11/2009 | Nishi et al. | |
| 7,614,223 | B2 * | 11/2009 | St. Aubin | F15B 21/042 60/327 |
| 8,234,860 | B2 * | 8/2012 | Beschorner | E02F 9/2235 60/329 |
| 8,286,748 | B2 | 10/2012 | Takahashi et al. | |
| 8,868,306 | B1 | 10/2014 | Shiina et al. | |
| 8,899,031 | B2 * | 12/2014 | Turnis | E02F 9/2246 60/329 |
| 9,096,989 | B2 | 8/2015 | Callaway et al. | |
| 9,316,167 | B2 | 4/2016 | Kato et al. | |
| 9,803,333 | B2 | 10/2017 | Horii | |
| 9,803,665 | B2 * | 10/2017 | Beschorner | F15B 21/042 |
| 2017/0370073 | A1 * | 12/2017 | Fukuda | E02F 9/2296 |

* cited by examiner

HYDRAULIC DRIVE CONTROL

CROSS-REFERENCE TO RELATED APPLICATIONS

The present application is based on and claims the benefit of U.S. provisional patent application Ser. No. 62/670,360, filed May 11, 2018, the contents of which is hereby incorporated by reference in its entirety.

BACKGROUND

This disclosure is directed toward power machines. More particularly, this disclosure is directed toward power machines having hydraulic systems, and to methods of controlling the hydraulic systems in cold temperature conditions.

Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Power machines having hydraulic systems sometimes operate in cold temperature conditions. Operation of the hydraulic system with the temperature of the hydraulic oil in the hydraulic system being too low can result in performance degradation, damage to components, or other undesirable results.

The discussion above is merely provided for general background information and is not intended to be used as an aid in determining the scope of the claimed subject matter.

SUMMARY

Disclosed embodiments include power machines having hydraulic systems and controllers configured to control, and sometimes limit or prohibit, operation of the hydraulic systems based upon measured temperature of the hydraulic oil in the system. Disclosed embodiments also include methods of controlling the hydraulic systems. In the methods implemented by the controllers, determinations are made as to whether the temperature of the hydraulic oil is below a first set point temperature, between the first set point temperature and a second set point temperature, or above the second set point temperature. The controllers then either prohibit hydraulic system operation, allow limited hydraulic system operation, or allow full hydraulic system operation, based upon the measured temperature in comparison to the two set point temperatures. In other embodiments, only a single set point temperature is utilized, and operation of at least part of the hydraulic system can be prevented at oil temperatures below the single set point temperature and allowed above the set point or alternatively operation is partially allowed or can be allowed with a ramping up of hydraulic system operation as a function of time.

In an exemplary embodiment, a disclosed power machine (100; 200; 350) comprises a hydraulic system (300) including a drive system having at least one drive pump (303) and at least one drive motor (226A; 226B; 306) which selectively receives hydraulic oil from the at least one drive pump to move the power machine in forward and reverse directions of travel. The drive pump has a variable hydraulic displacement controllable by controlling a percentage of a full pump stroke allowed. A temperature sensor (318) of the power machine is configured to measure a temperature of hydraulic oil in the hydraulic system and to provide a temperature signal indicative of the measured temperature. A user input device (322) of the power machine is configured to provide a user input signal responsive to actuation of the user input device by a user. A controller (320) of the power machine is coupled to the user input device, to the temperature sensor and to the at least one drive pump of the drive system. The controller is configured to receive the user input signal from the user input device and the temperature signal from the temperature sensor and to responsively generate drive control signals to control the at least one drive pump. The controller is configured to generate the drive control signals to: control the at least one drive pump to not move the power machine if the temperature of the hydraulic oil is below a first set point temperature; control the at least one drive pump responsive to the user input signal to allow a first percentage of the full pump stroke if the temperature of the hydraulic oil is at the first set point temperature and to allow the pump stroke to increase with temperature increases toward a second percentage of the full pump stroke, higher than the first percentage of the full pump stroke, at a second set point temperature higher than the first set point temperature; and control the at least one drive pump responsive to the user input signal to allow the full pump stroke if the temperature of the hydraulic oil is above the second set point temperature.

In some embodiments, the first percentage of the full pump stroke causes the power machine to move at a first speed, the second percentage of the full pump stroke causes the power machine to move at a second speed higher than the first speed, and the full pump stroke causes the power machine to move at a full speed higher than the second speed. In some embodiments, the second percentage of the full pump stroke is less than full pump stroke.

In some embodiments, the controller is configured such that when the temperature signal from the temperature sensor indicates that the temperature of the hydraulic oil has risen from below the second set point temperature to above the second set point temperature, the controller controls the at least one drive pump responsive to the user input signal to allow the full pump stroke only after the user input device has first been returned to a neutral position.

In some embodiments, the at least one drive motor is a two-speed drive motor configured to operate in a low range displacement mode and a high range displacement mode, and the controller is configured to control the at least one drive motor to prevent operation in the high range displacement mode when the temperature of the hydraulic oil is below the second set point temperature, but allow operation in the low range displacement mode when the temperature of the hydraulic oil is between the first set point temperature and the second set point temperature.

In some embodiments, the at least one drive pump comprises at least one hydrostatic drive pump.

In another exemplary embodiment, a power machine (100; 200; 350) includes a drive system having at least one drive pump (303) and at least one drive motor (226A; 226B; 306) which selectively receives hydraulic oil from the at least one drive pump to move the power machine in forward and reverse directions of travel, with the drive pump having a variable hydraulic displacement up to a maximum displacement corresponding to a full pump stroke. A temperature sensor (318) is configured to measure a temperature of hydraulic oil and to provide a temperature signal indicative of the measured temperature. A user input device (322) is configured to provide a user input signal, to command movement of the power machine using the drive system, responsive to actuation of the user input device by a user. A controller (320) is coupled to the user input device to receive the user input signal, to the temperature sensor to receive the temperature signal, and to the at least one drive pump of the drive system. The controller is configured to generate drive control signals to control the at least one drive pump responsive to the user input signal such that the controller prevents the drive system from moving the power machine if the temperature of the hydraulic oil is below a first set point temperature, to allow the drive system to move the power machine using a drive pump displacement varying between a first percentage of the full pump stroke when the temperature of the hydraulic oil is at the first set point temperature and a second percentage of the full pump stroke when the temperature of the hydraulic oil is at a second set point temperature higher than the first set point temperature, and to allow the drive system to move the power machine using the maximum displacement corresponding to the full pump stroke if the temperature of the hydraulic oil is above the second set point temperature.

In some embodiments, the first percentage of the full pump stroke causes the power machine to move at a first speed, the second percentage of the full pump stroke causes the power machine to move at a second speed higher than the first speed, and the full pump stroke causes the power machine to move at a speed higher than the second speed. In some embodiments, the second percentage of the full pump stroke is less than the full pump stroke.

In some embodiments, the controller is configured to generate the drive control signals to control the at least one drive pump responsive to the user input signal such that when the temperature signal from the temperature sensor indicates that the temperature of the hydraulic oil has risen from below the second set point temperature to above the second set point temperature, the controller allows the drive system to move the power machine using the maximum displacement corresponding to the full pump stroke only after the user input device has first been returned to a neutral position after the temperature of the hydraulic oil has risen to above the second set point temperature.

In some embodiments, the at least one drive motor is a two-speed drive motor configured to operate in a low range displacement mode and a high range displacement mode, and the controller is configured to control the at least one drive motor to prevent operation in the high range displacement mode when the temperature of the hydraulic oil is below the second set point temperature, but allow operation in the low range displacement mode when the temperature of the hydraulic oil is between the first set point temperature and the second set point temperature.

In another exemplary embodiment, a method (400) of controlling a drive system of a power machine (100; 200; 350) is provided. The drive system has at least one drive pump (303) and at least one drive motor (226A; 226B; 306), and the at least one drive pump has a variable hydraulic oil displacement up to a maximum displacement corresponding to a full pump stroke. The method comprises: measuring (402) a temperature of hydraulic oil in a hydraulic system (300) including the drive system; receiving a user input signal from a user input device (322); determining (406) whether the temperature of the hydraulic oil is below a first set point temperature; controlling (408) the at least one drive pump of the drive system to prevent movement of the power machine by the drive system if the temperature of the hydraulic oil is below the first set point temperature; determining (410), if the temperature of the hydraulic oil is above the first set point temperature, whether the temperature of the hydraulic oil is above or below a second set point temperature; controlling (414) the at least one drive pump of the drive system to move the power machine, responsive to the user input signal, using a drive pump displacement varying between a first percentage of the full pump stroke when the temperature of the hydraulic oil is at the first set point temperature and a second percentage of the full pump stroke when the temperature of the hydraulic oil is at the second set point temperature; and controlling (412) the at least one drive pump of the drive system to move the power machine, responsive to the user input signal, using the maximum displacement corresponding to the full pump stroke, if the temperature of the hydraulic oil is above the second set point temperature.

In some embodiments, the first percentage of the full pump stroke causes the power machine to move at a first speed, the second percentage of the full pump stroke causes the power machine to move at a second speed higher than the first speed, and the full pump stroke causes the power machine to move at a full speed higher than the second speed.

In some embodiments, the second percentage of the full pump stroke is less than the full pump stroke. For example, the first percentage of the full pump stroke can be approximately 10 percent and the second percentage of the full pump stroke can be approximately 60 percent.

In some embodiments, controlling (414) the at least one drive pump of the drive system to move the power machine, responsive to the user input signal, using the drive pump displacement varying between the first percentage of the full pump stroke and the second percentage of the full pump stroke further comprises varying the drive pump displacement as a function of temperature between the first percentage of the full pump stroke and the second percentage of the full pump stroke.

In some embodiments, when the temperature of the hydraulic oil has risen from below the second set point temperature to above the second set point temperature, then controlling (412) the at least one drive pump of the drive system further comprises controlling the at least one drive pump to move the power machine using the maximum displacement corresponding to the full pump stroke only after the user input device has first been returned to a neutral position.

In some embodiments, the at least one drive motor is a two-speed drive motor configured to operate in a low range displacement mode and a high range displacement mode, and the method further comprises controlling the at least one drive motor to prevent operation in the high range displacement mode when the temperature of the hydraulic oil is below the second set point temperature.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed embodiments establish hydraulic temperature zones of operation and control operation of hydraulic systems of power machines based upon what temperature zone hydraulic fluid in the power machine is in, the hydraulic temperature zone of operation being determined based upon a measured temperature of the hydraulic oil in the system. More particularly, the disclosed embodiments provide hydraulic temperature zones of operation for controlling operation of hydraulic systems when hydraulic oil is colder and sometimes significantly colder than the temperature of hydraulic oil during normal operation. In one embodiment, three zones of operation are defined. In some embodiments, three hydraulic temperature zones of operation are defined. The first zone of operation is defined as when the measured temperature of hydraulic oil in the system is below a first set point temperature. The second zone of operation is defined as when the hydraulic oil is above the first set point temperature and below a second set point temperature. The third zone of operation is defined as when the hydraulic oil is above the second set point temperature, above a second (and higher) set point temperature, or between the first and second set point temperatures. The hydraulic systems are then either prohibit from operation responsive to a user input, allowed limited operation responsive to the user input, or allowed full operation responsive to the user input, based upon the hydraulic temperature zone of operation. In other embodiments, only two hydraulic zones of operation are defined, with a first zone of operation being a single set point temperature is utilized, and hydraulic system operation can be prevented at oil temperatures below the single set point temperature, with increasing hydraulic system operation allowed as a function of time. In other embodiments, additional zones of operation are defined, which can allow for additional control schemes to be incorporated beyond those described above.

Figure 2:
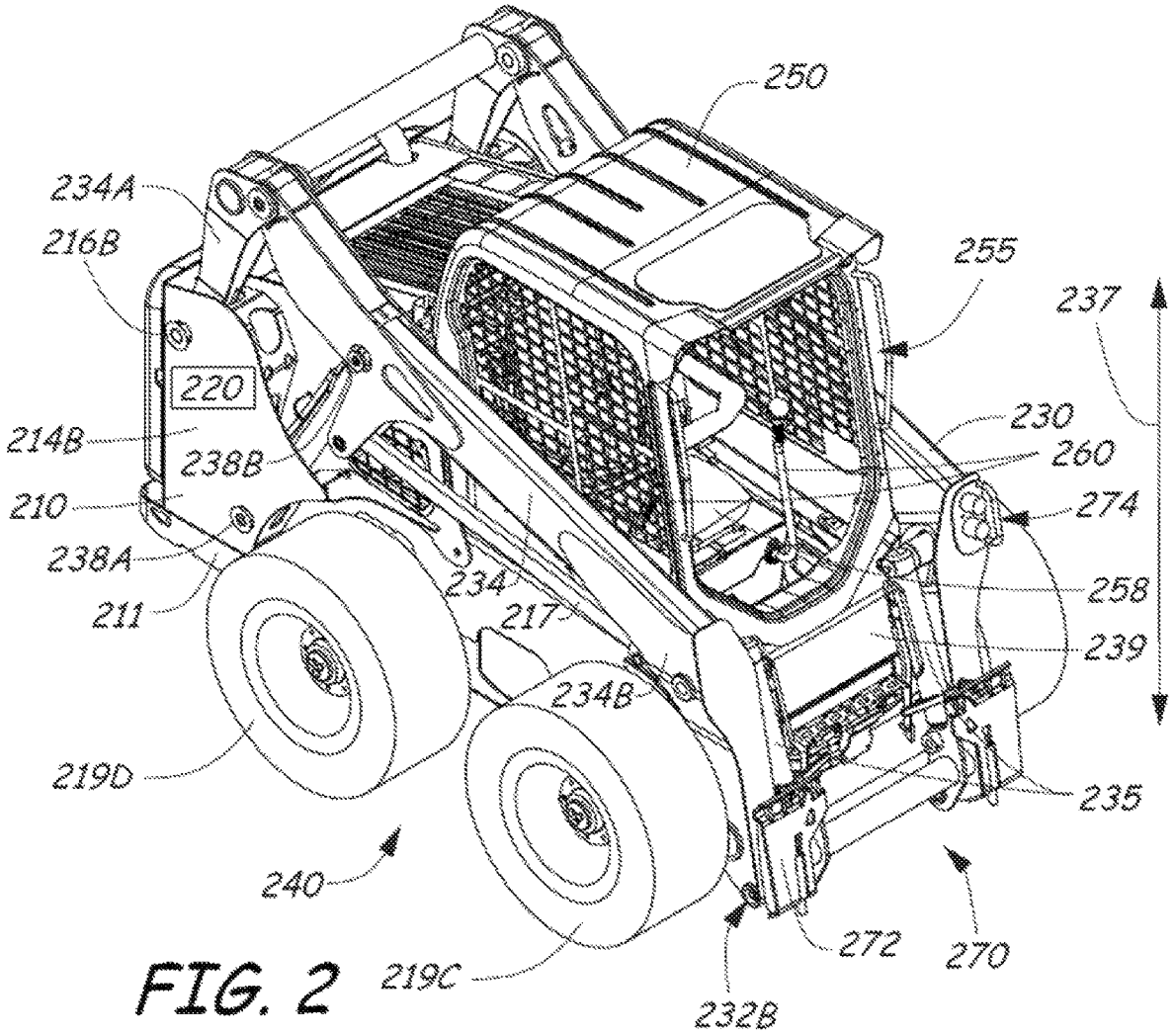
FIGS. 2-3 illustrate perspective views of a representative power machine in the form of a skid-steer loader of the type on which the disclosed embodiments can be practiced.
Figure 3:
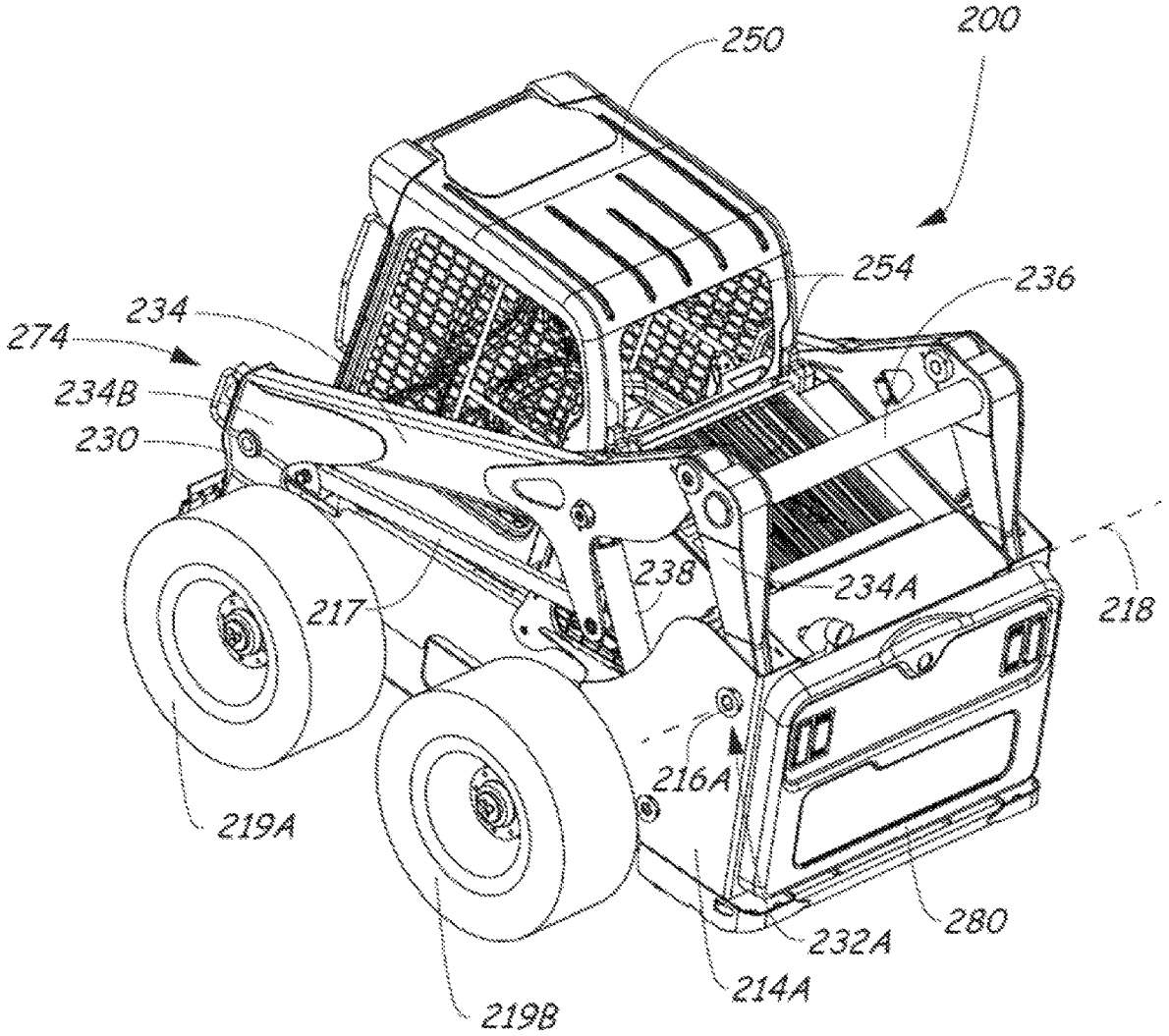

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is illustrated and discussed as being a representative power machine. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Figure 1:
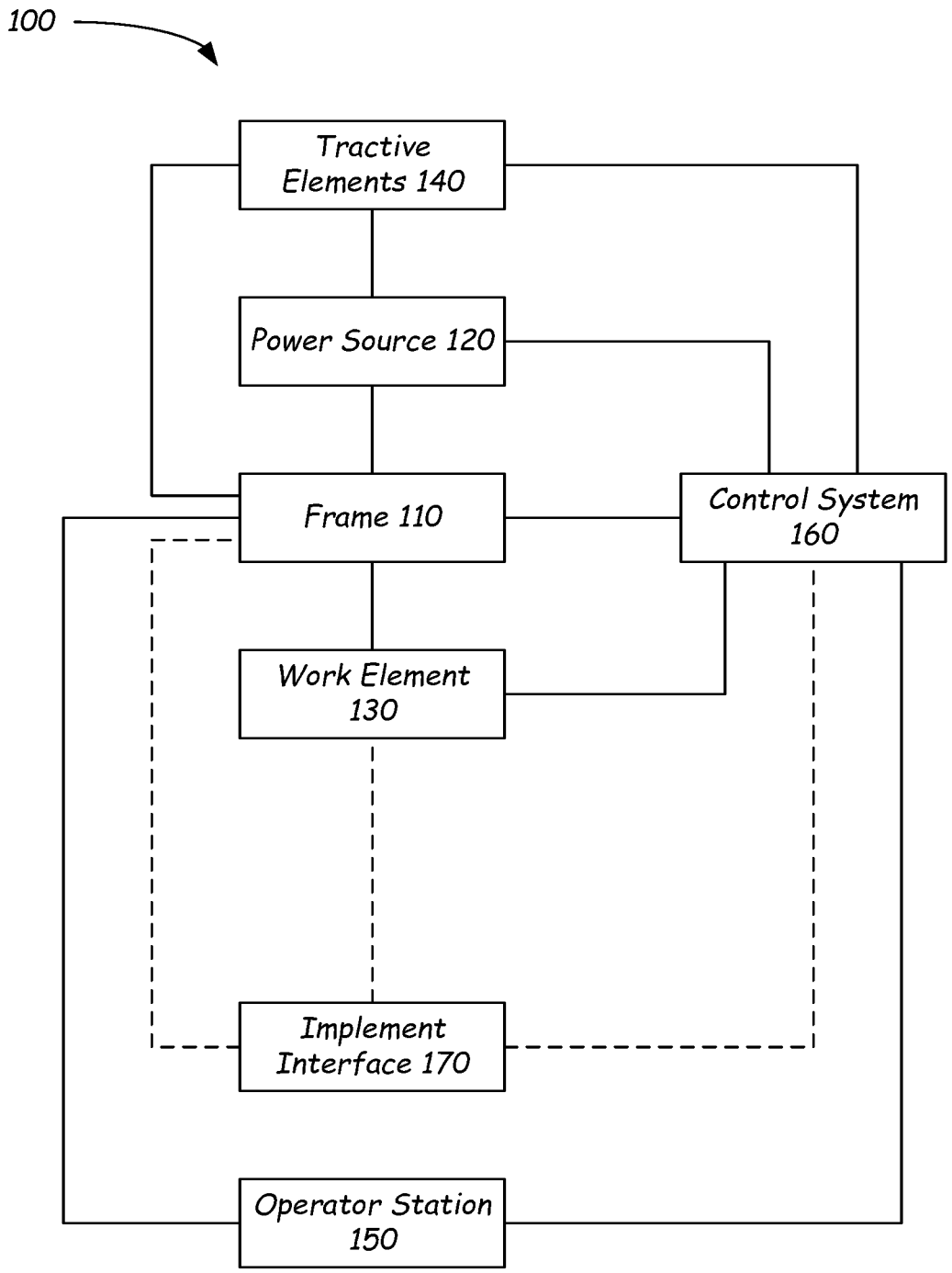
FIG. 1 is a block diagram illustrating functional systems of a representative power machine on which embodiments of the present disclosure can be advantageously practiced.

FIG. 1 is a block diagram that illustrates the basic systems of a power machine 100, which can be any of a number of different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that are capable of performing a dedicated task. For example, some work vehicles have a lift arm to which an implement such as a bucket is attached such as by a pinning arrangement. The work element, i.e., the lift arm can be manipulated to position the implement for the purpose of performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator controlled functions of the power machine can be operated from an operating position associated with an implement that is coupled to the power machine. Alternatively, with some power machines, a remote control device can be provided (i.e. remote from both of the power machine and any implement to which is it coupled) that is capable of controlling at least some of the operator controlled functions on the power machine.

FIGS. 2-3 illustrate a loader 200, which is one particular example of a power machine of the type illustrated in FIG. 1 where the embodiments discussed below can be advantageously employed. Loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements.

Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. Skid-steer loader 200 is described herein to provide a reference for understanding one environment on which the embodiments described below related to track assemblies and mounting elements for mounting the track assemblies to a power machine may be practiced. The loader 200 should not be considered limiting especially as to the description of features that loader 200 may have described herein that are not essential to the disclosed embodiments and thus may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220, the power system being capable of generating or otherwise providing power for operating various functions on the power machine. Power system 220 is shown in block diagram form, but is located within the frame 210. Frame 210 also supports a work element in the form of a lift arm assembly 230 that is powered by the power system 220 and is capable of performing various work tasks. As loader 200 is a work vehicle, frame 210 also supports a traction system 240, which is also powered by power system 220 and is capable of propelling the power machine over a support surface. The lift arm assembly 230 in turn supports an implement interface 270, which includes an implement carrier 272 that is capable of receiving and securing various implements to the loader 200 for performing various work tasks and power couplers 274, to which an implement can be coupled for selectively providing power to an implement that might be connected to the loader. Power couplers 274 can provide sources of hydraulic or electric power or both. The loader 200 includes a cab 250 that defines an operator station 255 from which an operator can manipulate various control devices 260 to cause the power machine to perform various work functions. Cab 250 can be pivoted back about an axis that extends through mounts 254 to provide access to power system components as needed for maintenance and repair.

The operator station 255 includes an operator seat 258 and a plurality of operation input devices, including control levers 260 that an operator can manipulate to control various machine functions. Operator input devices can include buttons, switches, levers, sliders, pedals and the like that can be stand-alone devices such as hand operated levers or foot pedals or incorporated into hand grips or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 100 include control of the tractive elements 219, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include and/or interacting with the embodiments discussed below can have various different frame components that support various work elements. The elements of frame 210 discussed herein are provided for illustrative purposes and frame 210 is not the only type of frame that a power machine on which the embodiments can be practiced can employ. Frame 210 of loader 200 includes an undercarriage or lower portion 211 of the frame and a mainframe or upper portion 212 of the frame that is supported by the undercarriage. The mainframe 212 of loader 200, in some embodiments is attached to the undercarriage 211 such as with fasteners or by welding the undercarriage to the mainframe. Alternatively, the mainframe and undercarriage can be integrally formed. Mainframe 212 includes a pair of upright portions 214A and 214B located on either side and toward the rear of the mainframe that support lift arm assembly 230 and to which the lift arm assembly 230 is pivotally attached. The lift arm assembly 230 is illustratively pinned to each of the upright portions 214A and 214B. The combination of mounting features on the upright portions 214A and 214B and the lift arm assembly 230 and mounting hardware (including pins used to pin the lift arm assembly to the mainframe 212) are collectively referred to as joints 216A and 216B (one is located on each of the upright portions 214) for the purposes of this discussion. Joints 216A and 216B are aligned along an axis 218 so that the lift arm assembly is capable of pivoting, as discussed below, with respect to the frame 210 about axis 218. Other power machines may not include upright portions on either side of the frame, or may not have a lift arm assembly that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports a pair of tractive elements in the form of wheels 219A-D on either side of the loader 200.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is what is known as a vertical lift arm, meaning that the lift arm assembly 230 is moveable (i.e. the lift arm assembly can be raised and lowered) under control of the loader 200 with respect to the frame 210 along a lift path 237 that forms a generally vertical path. Other lift arm assemblies can have different geometries and can be coupled to the frame of a loader in various ways to provide lift paths that differ from the radial path of lift arm assembly 230. For example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the inventive concepts set forth in this discussion are limited by the type or number of lift arm assemblies that are coupled to a particular power machine.

The lift arm assembly 230 has a pair of lift arms 234 that are disposed on opposing sides of the frame 210. A first end of each of the lift arms 234 is pivotally coupled to the power machine at joints 216 and a second end 232B of each of the lift arms is positioned forward of the frame 210 when in a lowered position as shown in FIG. 2. Joints 216 are located toward a rear of the loader 200 so that the lift arms extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. Cross member 236 provides increased structural stability to the lift arm assembly 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm assembly 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e. along a pre-determined path) as is the case in the lift arm assembly 230 shown in FIG. 2. Some power machines have lift arm assemblies with a single lift arm, such as is known in excavators or even some loaders and other power machines. Other power machines can have a plurality of lift arm assemblies, each being independent of the other(s).

An implement interface 270 is provided proximal to a second end 232B of the lift arm assembly 234. The implement interface 270 includes an implement carrier 272 that is capable of accepting and securing a variety of different implements to the lift arm 230. Such implements have a complementary machine interface that is configured to be engaged with the implement carrier 272. The implement carrier 272 is pivotally mounted at the second end 232B of the arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative ease. For example, machines with implement carriers can provide an actuator between the implement carrier and the lift arm assembly, so that removing or attaching an implement does not involve removing or attaching an actuator from the implement or removing or attaching the implement from the lift arm assembly. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes an implement power source 274 available for connection to an implement on the lift arm assembly 230. The implement power source 274 includes pressurized hydraulic fluid port to which an implement can be removably coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The implement power source 274 also exemplarily includes electrical conduits that are in communication with a data bus on the excavator 200 to allow communication between a controller on an implement and electronic devices on the loader 200.

Figure 4:
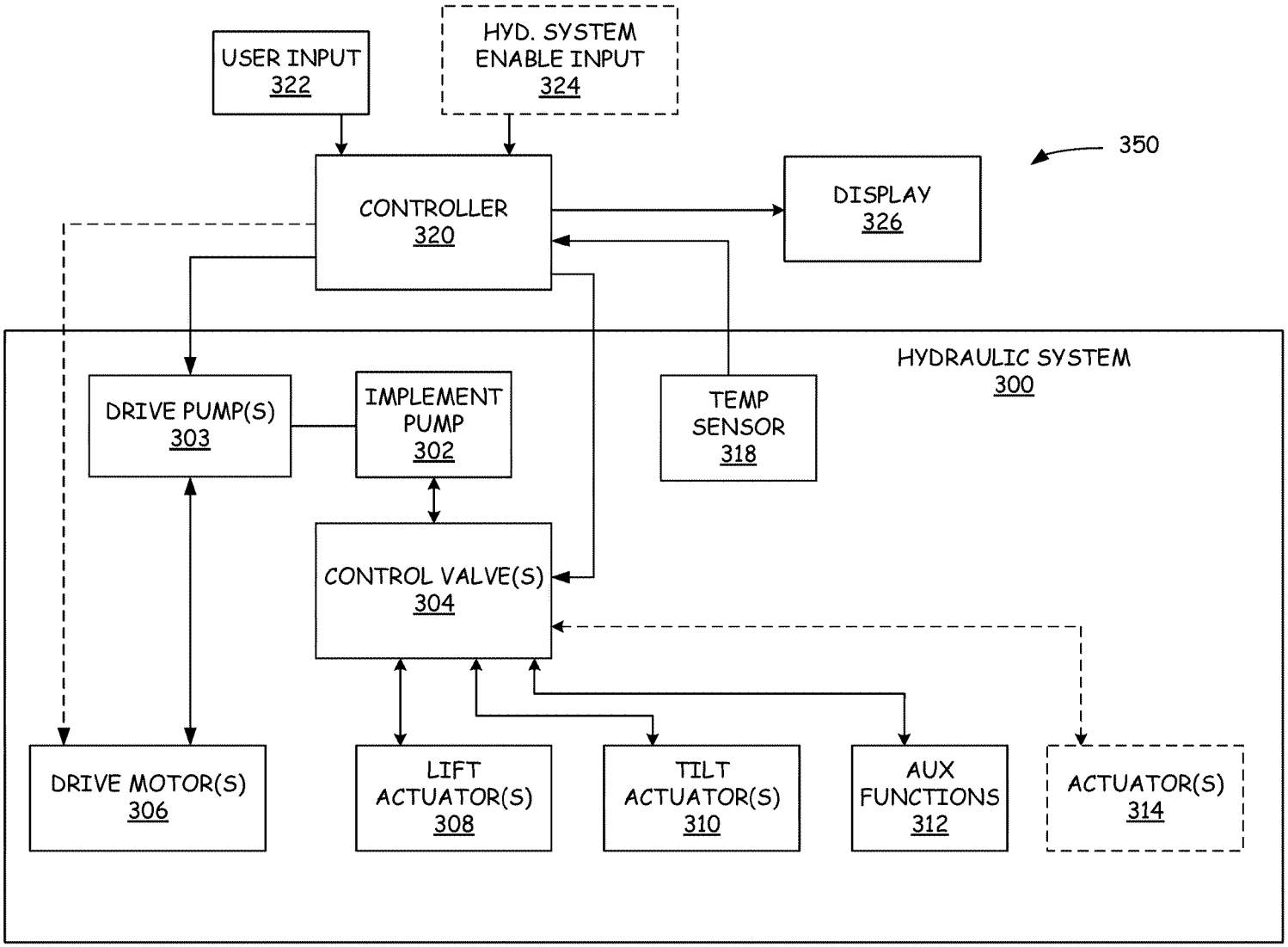
FIG. 4 is a block diagram illustrating components of a hydraulic system of a power machine such as the loader illustrated in FIGS. 2-3.

Frame 210 supports and generally encloses the power system 220 so that the various components of the power system 220 are not visible in FIGS. 2-3. FIG. 4 includes, among other things, a diagram of various components of the power system 220. Power system 220 includes one or more power sources 222 that are capable of generating and/or storing power for use on various machine functions. On power machine 200, the power system 220 includes an internal combustion engine. Other power machines can include electric generators, rechargeable batteries, various other power sources or any combination of power sources that are capable of providing power for given power machine components. The power system 220 also includes a power conversion system 224, which is operably coupled to the power source 222. Power conversion system 224 is, in turn, coupled to one or more actuators 226, which are capable of performing a function on the power machine. Power conversion systems in various power machines can include various components, including mechanical transmissions, hydraulic systems, and the like. The power conversion system 224 of power machine 200 includes a pair of hydrostatic drive pumps 224A and 224B, which are selectively controllable to provide a power signal to drive motors 226A and 226B. The drive motors 226A and 226B in turn are each operably coupled to axles, with drive motor 226A being coupled to axles 228A and 228B and drive motor 226B being coupled to axles 228C and 228D. The axles 228A-D are in turn coupled to tractive elements 219A-D, respectively. The drive pumps 224A and 224B can be mechanically, hydraulic, and/or electrically coupled to operator input devices to receive actuation signals for controlling the drive pumps.

The arrangement of drive pumps, motors, and axles in power machine 200 is but one example of an arrangement of these components. As discussed above, power machine 200 is a skid-steer loader and thus tractive elements on each side of the power machine are controlled together via the output of a single hydraulic pump, either through a single drive motor as in power machine 200 or with individual drive motors. Various other configurations and combinations of hydraulic drive pumps and motors can be employed as may be advantageous.

The power conversion system 224 of power machine 200 also includes a hydraulic implement pump 224C, which is also operably coupled to the power source 222. The hydraulic implement pump 224C is operably coupled to work actuator circuit 238C. Work actuator circuit 238 includes lift cylinders 238 and tilt cylinders 235 as well as control logic (such as one or more valves) to control actuation thereof. The control logic selectively allows, in response to operator inputs, for actuation of the lift cylinders and/or tilt cylinders. In some machines, the work actuator circuit also includes control logic to selectively provide a pressurized hydraulic fluid to an attached implement.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Referring now to FIG. 4, shown are components of a power machine 350, such as those discussed above with reference to FIGS. 1-3, which provides a hydraulic system 300 and a controller 320 configured to control the hydraulic system over a range of different hydraulic oil temperatures. Hydraulic system 300 includes at least one hydraulic pump 302 configured to provide pressurized hydraulic fluid or oil to power one or more actuators. In an exemplary embodiment, hydraulic system 300 includes one or more control valves 304 to selectively control the application of hydraulic oil flow to the actuators. Control valve 304, in some embodiments is a multiple spool, open center valve assembly, the spools being independently actuable to control hydraulic actuators. Examples of hydraulic actuators lift actuator(s) 308 configured to raise and lower a lift arm, tilt actuator(s) 310 configured to rotate an implement carrier and any attached implement relative to the lift arm or relative to the frame of the power machine, and auxiliary function actuators 312 such as those found on hydraulically powered implements. These example actuators are not required in all embodiments, and hydraulic system 300 can include, in some embodiments, other types of actuators, instead of or in addition to those discussed above, represented in FIG. 4 as actuators 314. Hydraulic pump 302 is a constant displacement gear pump, but in other embodiments can be a variable displacement pump. Hydraulic system 300 can also include one or more drive pumps 303, which are coupled to one or more drive motors 306 to selectively move the power machine in forward and reverse directions of travel. Drive pumps 303 are hydrostatic pumps. In other embodiments, hydraulic drive systems that include control valves to direct flow from hydraulic pumps can be employed for drive systems, but these embodiments are not shown for the sake of brevity. The one or more drive pumps 303 are shown as being mechanically linked to pump 302. In various embodiments, all the hydraulic and hydrostatic pumps are driven by a single prime mover, such as an engine or electric motor, although that need not be the case in every embodiment. In some embodiments, drive motors 306 are so-called two-speed motors, with two different displacements, including a low range displacement and a high range displacement. In those embodiments, controller 320 can communicate with the drive motors 306 to control their displacement. Other embodiments can include drive motors with multiple displacements or infinitely variable displacements. Controller 320 can be configured to communicate with these types of drive motors as well to control their displacement.

Hydraulic system 300 also includes at least one temperature sensor 318 configured to measure the temperature of hydraulic oil in the hydraulic system and to provide a temperature signal indicative of the measured temperature to controller 320. Temperature sensor 318 can be positioned at any suitable location within the hydraulic system to measure the temperature of the hydraulic oil. Further, in some embodiments, multiple temperature sensors and/or switches such as temperature sensor 318 are positioned at various different locations within the hydraulic system. For example, temperature sensors can be positioned at one or more of the input or output of the hydraulic pump, at the input or output of the control valve 304, at the input or output of any of the illustrated actuators, or hydraulic cooling elements (which are not shown in FIG. 4), and so forth.

FIG. 4 illustrates a user input device 322 that is in communication with controller 320. User input device 322 is manipulable by an operator to allow an operator to communicate an intention to operator the power machine to controller 320. In various embodiments, any number of user input devices, such as joystick controllers, levers, foot pedals, and the like are configured to be actuated by an operator of the power machine and to provide user input signals indicative of intentions to control various actuators to controller 320. In addition, in some embodiments, a hydraulic system enable input 324 is also included and is required to be actuated by the user prior to operation of some or all of the hydraulic functions of the power machine hydraulic system 300. For example, an enabling input such as a button, a seat bar sensor, or other types of inputs or any combination thereof can be included and required to be actuated prior to operation of the hydraulic system. Such hydraulic system enabling inputs 324 are not required in all embodiments, and for purposes of the present disclosure, are not further discussed with regard to implementation of the disclosed control methods for controlling hydraulic system 300. Nevertheless, those skilled in the art will understand that, when hydraulic system enabling inputs are included or required, such inputs can prevent operation of the hydraulic system 300 when not properly actuated even if an operator has actuated one or more user input devices 322. Some embodiments such as the one shown in FIG. 4 include display device 326 that is in communication with controller 320 and is configured to display information to the operator, including information discussed below with reference to operational limitations allowed in different oil temperature zones of operation.

In exemplary embodiments, controller 320 is configured to control operation of hydraulic system 300, responsive to user input signals from the one or more user input devices 322 over a range of temperatures including cold temperature operation. This requires the temperature of the hydraulic oil to be increased to a sufficient temperature prior to allowing full operation of the hydraulic system. In various embodiments, one or more set point temperatures are used to define hydraulic temperature zones of operation during which the hydraulic system is disabled, limited, or fully operational.

Figure 5:
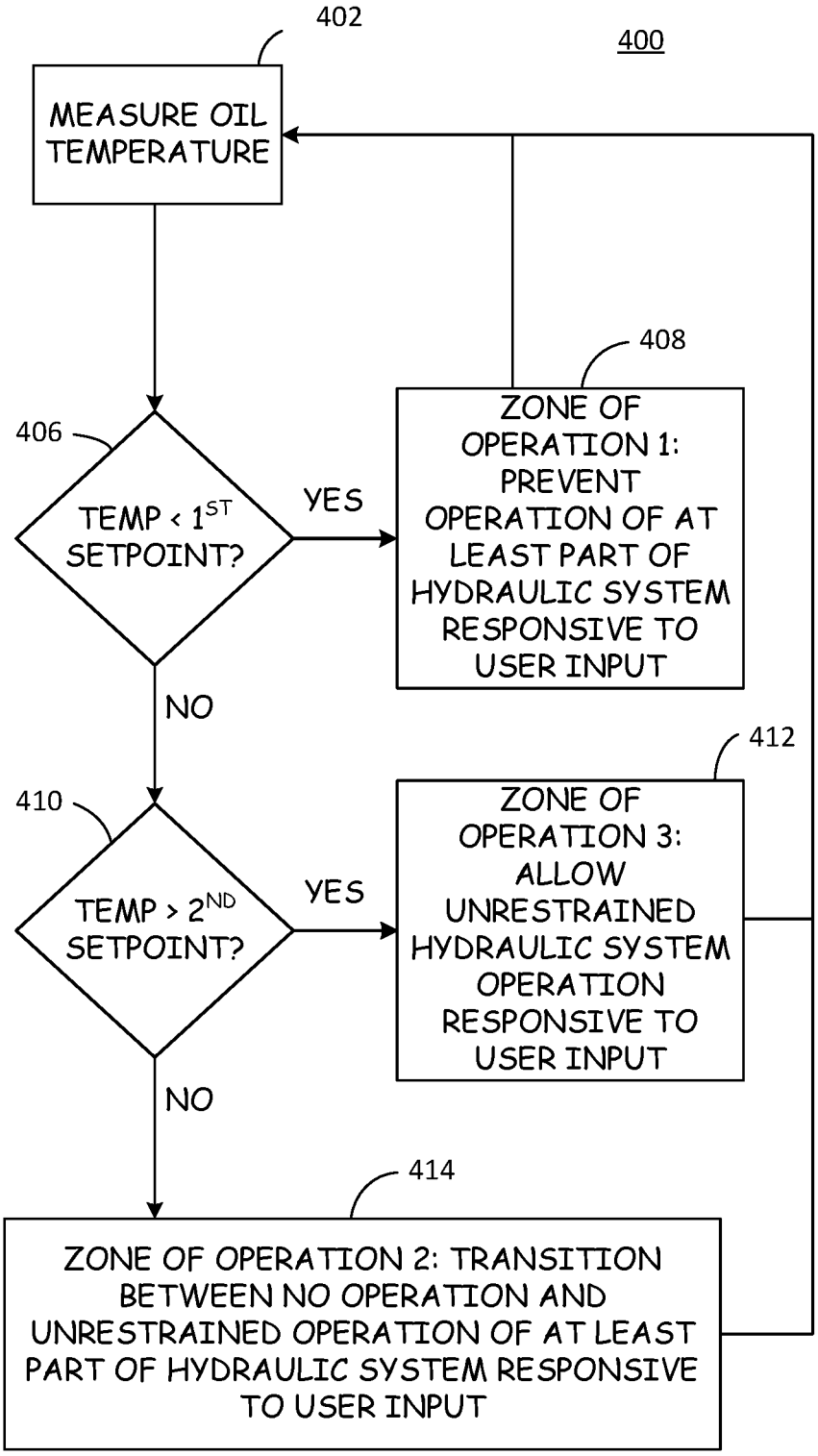
FIG. 5 is a flow diagram illustrating a method of controlling the hydraulic system of a power machine in cold temperature conditions using multiple set point temperatures.

Referring now to FIG. 5, shown is a flow diagram illustrating a method 400 of controlling hydraulic system 300 according to one illustrative embodiment. Controller 320 can be configured to implement method 400, or similar methods, in implementing oil temperature based hydraulic system control. As shown at block 402, the oil temperature in hydraulic system 300 is measured using one or more temperature sensors and/or switches. The user input signal will typically correspond to a user actuating the user input device in an attempt to cause the power machine to perform a work operation such as travel, raising or lowering the lift arm, rolling the implement carrier and any attached implement forward or backward using at tilt actuator, etc. However, in some embodiments, the user input can simply be a signal from the user input device indicating that the user input device remains in a neutral position. It yet other embodiments, no user input signal is required. For instance, as will be discussed below, the control methods can include displaying information identifying that hydraulic system functionality is prohibited or limited whether a user input is received or not.

Next, as shown at decision block 406, controller 320 determines based on inputs from the temperature sensors and/or switches, whether the hydraulic oil temperature is below a first set point temperature. If the hydraulic oil temperature is below the first set point temperature, the controller 320 operates under the rules of a first hydraulic temperature zone of operation. The first set point temperature represents a temperature below which the hydraulic system functions are disabled to prevent the operator from performing work functions while the hydraulic oil warms. Thus, in the first zone of operation, the controller 320 is configured to prevent operation of the hydraulic system, even responsive to user input signals. The rules of the first hydraulic temperature zone of operation are shown at block 408. When the power machine is operating in the first hydraulic temperature zone of operation, in some embodiments, controller 320 also controls display 326 to show the operator a "COLD" warning and/or to indicate that no machine travel or work functions are available. In other embodiments, in the first hydraulic temperature zone of operation, the controller 320 may prevent operation of only some hydraulic functions. For example, the controller 320 in some embodiments may prevent operation of the drive system while allowing for operation of other functions such as auxiliary functions and lift and tilt functions. In some embodiments where a variable displacement implement pump 302 is employed, the controller 320 can actuate the implement pump 302 even when functions that obtain pressurized hydraulic fluid from the implement pump are not actuated. This can allow pressurized hydraulic fluid to move through the control valve 304 and cause the hydraulic fluid to warm more quickly.

If the controller determines at decision block 406 that the measured oil temperature is above the first set point temperature, the controller determines, at decision block 10, whether hydraulic fluid temperature is above a second set point temperature. For example, the second set point temperature can be 20° F., though other second set point temperatures can be used. The second set point temperature represents a temperature above which normal or full hydraulic system operation is allowed. If it is determined at decision block 410 that the oil temperature is above the second set point temperature, then the controller 320 determines that it should operate in the hydraulic temperature third zone of operation at block 412 and allow full and unrestrained (at least because of hydraulic fluid temperature) hydraulic system operation responsive to the user input. If the operator is manipulating one or more user input devices as the controller 320 transitions from a second hydraulic temperature zone of operation (discussed below) to the third hydraulic temperature zone of operation, in some embodiments the controller 320 is configured to require that any or all user input devices that are being manipulated be returned to a neutral or non-manipulated position before the controller allows unrestrained operation hydraulic functions that were being restrained in the second hydraulic temperature zone of operation. This prevents a sudden and rapid increase in the travel speed or other hydraulic function once the hydraulic fluid temperature reaches the second set point temperature. Also, in some embodiments, once the hydraulic fluid temperature reaches the second set point temperature, controller 320 controls the display 326 to provide an indication of normal hydraulic system functionality.

If the controller 320 determines, at decision block 410, that the hydraulic fluid temperature is below the second set point temperature, controller 320 operates in the second hydraulic temperature zone of operation and controls the hydraulic system to allow limited operation of hydraulic system 300 as shown at block 414. This limited functionality can be controlled in various manners to transition between no operation of the hydraulic system and partial or full operation of the hydraulic system. The transition can include further set points between the first and second set point temperatures to create additional oil temperature zones or regions of hydraulic system control, though additional set points are not required in all embodiments.

In one exemplary embodiment, controller 320 is further configured to utilize a third set point temperature, between the first and second set point temperatures, and to control the hydraulic system differently depending upon whether the measured temperature is between the first and third set point temperatures or between the third and second set point temperatures. For example, in one embodiment, a third set point temperature of 10° F. is used for the third set point temperature. If the controller determines that the measured oil temperature is between the first set point temperature (e.g., 0° F.) and the third set point temperature (e.g., 10° F.), then the controller allows the drive pumps 303 to function at a limited percentage of the full pump stroke. For example, in some embodiments, between the first and third set point temperatures, pump 302 can be allowed only to operate at only 10% of the full pump stroke. Other maximum pump stroke percentages can also be used. Further, the controller 320 can control the drive motors 306 (when they are two-speed motors or infinitely variable displacement motors) to prevent operation in the high range displacement or, in the case of infinitely variable displacement motors prevent operation of the motors above a minimum displacement, while allowing low range operation. Display device 326 can similarly be controlled to notify the operator of the "COLD" condition and limited available operation of the hydraulic system.

If the controller determines that the measured oil temperature is between the third set point temperature (e.g., 10° F.) and the second set point temperature (e.g., 20° F.), then the controller allows the drive pumps 303 to ramp up slowly from the limited maximum percentage of pump stroke of the previous temperature range, to a higher maximum pump stroke percentage. For example, in one embodiment, controller 320 allows pumps 303 to slowly ramp from 10% of maximum pump stroke to 60% of maximum pump stroke as the temperature increases from the third set point temperature to the second set point temperature. The transition between the limited maximum percentage of pump stroke of the previous temperature range (e.g., 10%) to the higher maximum pump stroke percentage (e.g., 60%) can be a linear function of temperature, a piecewise linear function of temperature, a step function of temperature, an exponential function of temperature, or controlled by other types of functions correlating temperature to maximum percentage of pump stroke allowed. In some embodiments, between the third and second set point temperatures, only low range operation is allowed, while high range operation is still prohibited. Display device 326 can again be controlled to notify the operator of the "COLD" condition and limited available operation of the hydraulic system.

Although some disclosed embodiments utilize multiple set point temperatures and three (or more) zones of operation, this need not be the case in all embodiments, and instead a single set point temperature can be utilized. For instance, in some embodiments, a single set point temperature is utilized (e.g., the first set point temperature 0° F.), and if the controller determines that the measured oil temperature is below the first set point temperature, hydraulic system operation can initially be prevented, but increasingly allowed based upon time elapsed. One such example of such an embodiment is method 500, which is illustrated in the flow diagram shown in FIG. 6.

Figure 6:
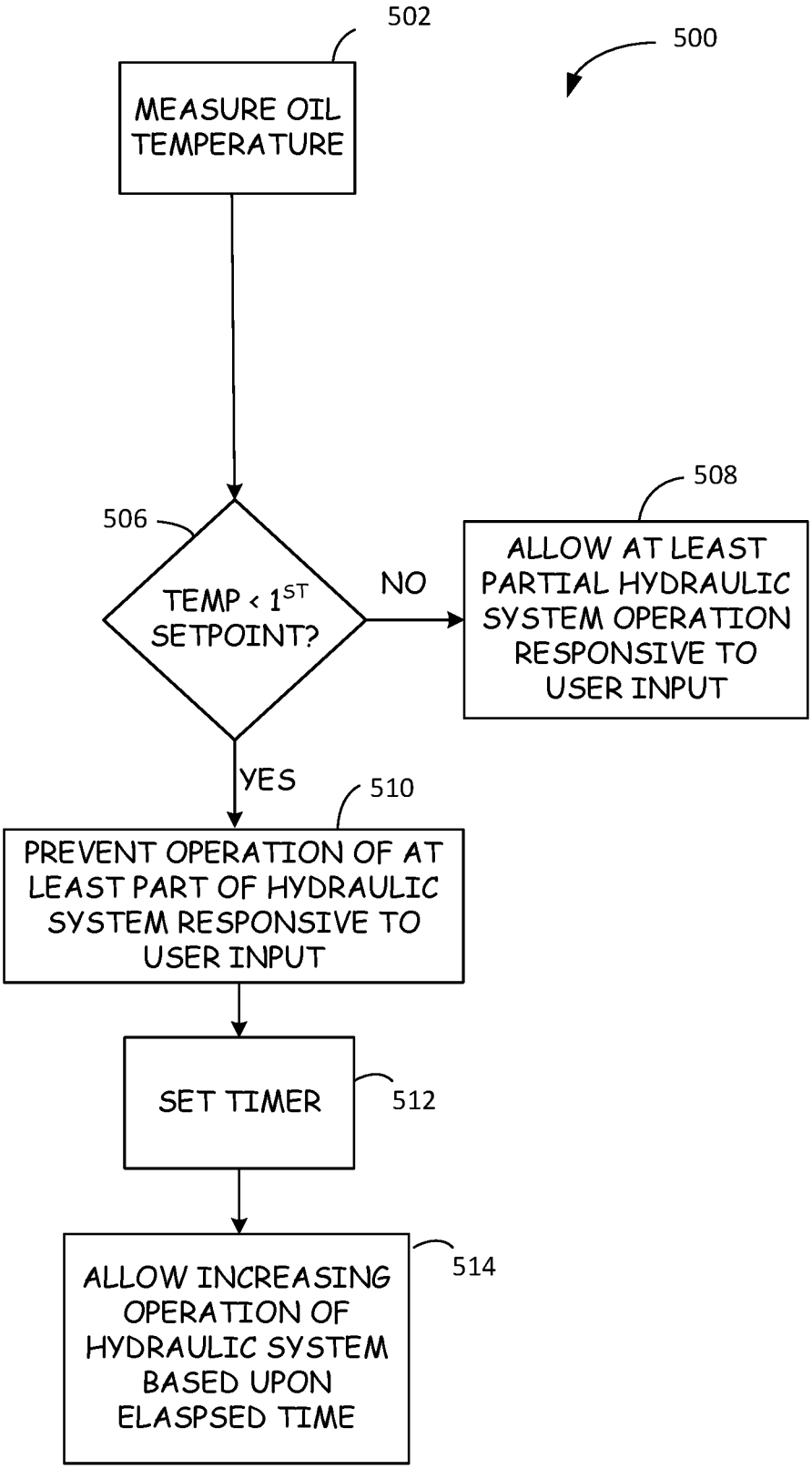
FIG. 6 is a flow diagram illustrating another method of controlling the hydraulic system of a power machine in cold temperature conditions using only a single set point temperature.

As shown at block 502 of FIG. 6, the oil temperature in hydraulic system 300 is measured using one or more temperature sensors. Next, as shown at decision block 506, a determination is made as to whether the oil temperature is below a first set point temperature. For example, the first set point temperature can be 0° F., though other first set point temperatures can be used. If it is determined that the measured oil temperature is above the first set point temperature, then at block 508 the controller 320 allows at least partial operation of the hydraulic system responsive to user input signals. This can include allowing full operation of the hydraulic system in some embodiments.

If it is determined that the measured oil temperature is not above the first set point temperature, then at block 510 the controller initially prevents operation of at least part of the hydraulic system responsive to user inputs but sets a timer at block 512. Then, as shown at block 514, the controller allows increasing operation of the hydraulic system based upon the elapsed time indicated by the timer. For instance, at predetermined amounts of elapsed time, the controller can increase drive pump stroke percentage to predetermined and increasing values. Other types of time-based increased hydraulic system operation are also possible, for example allowing control of different actuators after different amounts of elapsed time (e.g., travel before lift arm operation), allowing high range motor operation, and the like. Alternatively, using the single temperature set point, operation of at least part of the hydraulic system is not allowed below the temperature set point and fully allowed above the temperature set point.

Although the present invention has been described with reference to preferred embodiments, workers skilled in the art will recognize that changes may be made in form and detail without departing from the scope of the discussion.

What is claimed is:

1. A power machine comprising:

a hydraulic system including a drive system having at least one drive pump and at least one drive motor which selectively receives hydraulic oil from the at least one drive pump to move the power machine in forward and reverse directions of travel, the drive pump having a variable hydraulic displacement controllable by controlling a percentage of a full pump stroke allowed;

a temperature sensor configured to measure a temperature of hydraulic oil in the hydraulic system and to provide a temperature signal indicative of the measured temperature;

a user input device configured to provide a user input signal responsive to actuation of the user input device by a user;

a controller coupled to the user input device, to the temperature sensor and to the at least one drive pump of the drive system, the controller configured to receive the user input signal from the user input device and the temperature signal from the temperature sensor and to responsively generate drive control signals to control the at least one drive pump, wherein the controller is configured to generate the drive control signals to:

control the at least one drive pump to not move the power machine if the temperature of the hydraulic oil is below a first set point temperature;

control the at least one drive pump responsive to the user input signal to allow a first percentage of the full pump stroke if the temperature of the hydraulic oil is at the first set point temperature and to allow the pump stroke to increase with temperature increases toward a second percentage of the full pump stroke, higher than the first percentage of the full pump stroke, at a second set point temperature higher than the first set point temperature; and control the at least one drive pump responsive to the user input signal to allow the full pump stroke if the temperature of the hydraulic oil is above the second set point temperature.

2. The power machine of claim 1, wherein the first percentage of the full pump stroke causes the power machine to move at a first speed, the second percentage of the full pump stroke causes the power machine to move at a second speed higher than the first speed, and the full pump stroke causes the power machine to move at a full speed higher than the second speed.

3. The power machine of claim 1, wherein the second percentage of the full pump stroke is less than full pump stroke.

4. The power machine of claim 3, wherein the controller is configured such that when the temperature signal from the temperature sensor indicates that the temperature of the hydraulic oil has risen from below the second set point temperature to above the second set point temperature, the controller controls the at least one drive pump responsive to the user input signal to allow the full pump stroke only after the user input device has first been returned to a neutral position.

5. The power machine of claim 1, wherein the at least one drive motor is a two-speed drive motor configured to operate in a low range displacement mode and a high range displacement mode, and wherein the controller is configured to control the at least one drive motor to prevent operation in the high range displacement mode when the temperature of the hydraulic oil is below the second set point temperature, but allow operation in the low range displacement mode when the temperature of the hydraulic oil is between the first set point temperature and the second set point temperature.

6. The power machine of claim 1, wherein the at least one drive pump comprises at least one hydrostatic drive pump.

7. A power machine comprising:

a drive system having at least one drive pump and at least one drive motor which selectively receives hydraulic oil from the at least one drive pump to move the power machine in forward and reverse directions of travel, the drive pump having a variable hydraulic displacement up to a maximum displacement corresponding to a full pump stroke;

a temperature sensor configured to measure a temperature of hydraulic oil and to provide a temperature signal indicative of the measured temperature;

a user input device configured to provide a user input signal, to command movement of the power machine using the drive system, responsive to actuation of the user input device by a user; and a controller coupled to the user input device to receive the user input signal, to the temperature sensor to receive the temperature signal, and to the at least one drive pump of the drive system, the controller configured to generate drive control signals to control the at least one drive pump responsive to the user input signal such that the controller prevents the drive system from moving the power machine if the temperature of the hydraulic oil is below a first set point temperature, allows the drive system to move the power machine using a drive pump displacement varying between a first percentage of the full pump stroke when the temperature of the hydraulic oil is at the first set point temperature and a second percentage of the full pump stroke when the temperature of the hydraulic oil is at a second set point temperature higher than the first set point temperature, and allows the drive system to move the power machine using the maximum displacement corresponding to the full pump stroke if the temperature of the hydraulic oil is above the second set point temperature.

8. The power machine of claim 7, wherein the first percentage of the full pump stroke causes the power machine to move at a first speed, the second percentage of the full pump stroke causes the power machine to move at a second speed higher than the first speed, and the full pump stroke causes the power machine to move at a speed higher than the second speed.

9. The power machine of claim 8, wherein the second percentage of the full pump stroke is less than the full pump stroke.

10. The power machine of claim 9, wherein the controller is configured to generate the drive control signals to control the at least one drive pump responsive to the user input signal such that when the temperature signal from the temperature sensor indicates that the temperature of the hydraulic oil has risen from below the second set point temperature to above the second set point temperature, the controller allows the drive system to move the power machine using the maximum displacement corresponding to the full pump stroke only after the user input device has first been returned to a neutral position after the temperature of the hydraulic oil has risen to above the second set point temperature.

11. The power machine of claim 7, wherein the at least one drive motor is a two-speed drive motor configured to operate in a low range displacement mode and a high range displacement mode, and wherein the controller is configured to control the at least one drive motor to prevent operation in the high range displacement mode when the temperature of the hydraulic oil is below the second set point temperature, but allow operation in the low range displacement mode when the temperature of the hydraulic oil is between the first set point temperature and the second set point temperature.

12. The power machine of claim 7, wherein the at least one drive pump comprises at least one hydrostatic drive pump.

13. A method of controlling a drive system of a power machine, the drive system having at least one drive pump and at least one drive motor, the at least one drive pump having a variable hydraulic oil displacement up to a maximum displacement corresponding to a full pump stroke, the method comprising:

measuring a temperature of hydraulic oil in a hydraulic system including the drive system;

receiving a user input signal from a user input device;

determining whether the temperature of the hydraulic oil is below a first set point temperature;

controlling the at least one drive pump of the drive system to prevent movement of the power machine by the drive system if the temperature of the hydraulic oil is below the first set point temperature;

determining, if the temperature of the hydraulic oil is above the first set point temperature, whether the temperature of the hydraulic oil is above or below a second set point temperature;

controlling the at least one drive pump of the drive system to move the power machine, responsive to the user input signal, using a drive pump displacement varying between a first percentage of the full pump stroke when the temperature of the hydraulic oil is at the first set point temperature and a second percentage of the full pump stroke when the temperature of the hydraulic oil is at the second set point temperature;

controlling the at least one drive pump of the drive system to move the power machine, responsive to the user input signal, using the maximum displacement corresponding to the full pump stroke, if the temperature of the hydraulic oil is above the second set point temperature.

14. The method of claim 13, wherein the first percentage of the full pump stroke causes the power machine to move at a first speed, the second percentage of the full pump stroke causes the power machine to move at a second speed higher than the first speed, and the full pump stroke causes the power machine to move at a full speed higher than the second speed.

15. The method of claim 13, wherein the second percentage of the full pump stroke is less than the full pump stroke.

16. The method of claim 15, wherein the first percentage of the full pump stroke is approximately 10 percent and wherein the second percentage of the full pump stroke is approximately 60 percent.

17. The method of claim 13, wherein controlling the at least one drive pump of the drive system to move the power machine, responsive to the user input signal, using the drive pump displacement varying between the first percentage of the full pump stroke and the second percentage of the full pump stroke further comprising varying the drive pump displacement as a function of temperature between the first percentage of the full pump stroke and the second percentage of the full pump stroke.

18. The method of claim 13, wherein when the temperature of the hydraulic oil has risen from below the second set point temperature to above the second set point temperature, then controlling the at least one drive pump of the drive system further comprises controlling the at least one drive pump to move the power machine using the maximum displacement corresponding to the full pump stroke only after the user input device has first been returned to a neutral position.

19. The method of claim 13, wherein the at least one drive motor is a two-speed drive motor configured to operate in a low range displacement mode and a high range displacement mode, the method further comprising controlling the at least one drive motor to prevent operation in the high range displacement mode when the temperature of the hydraulic oil is below the second set point temperature.

* * * * *